US009033061B2

(12) United States Patent
Chattaway et al.

(10) Patent No.: US 9,033,061 B2
(45) Date of Patent: May 19, 2015

(54) FIRE SUPPRESSION SYSTEM AND METHOD

(75) Inventors: Adam Chattaway, Windsor (GB); Josephine Gabrielle Gatsonides, Dunstable (GB); Robert G. Dunster, Slough (GB); Terry Simpson, Wake Forest, NC (US); Dharmendr Len. Seebaluck, Wake Forest, NC (US); Robert E. Glaser, Stella, NC (US)

(73) Assignee: Kidde Technologies, Inc., Wilson, NC (US)

( * ) Notice: Subject to any disclaimer, the term of this patent is extended or adjusted under 35 U.S.C. 154(b) by 1296 days.

(21) Appl. No.: 12/470,817

(22) Filed: May 22, 2009

(65) Prior Publication Data

US 2010/0236796 A1 Sep. 23, 2010

Related U.S. Application Data

(60) Provisional application No. 61/210,842, filed on Mar. 23, 2009.

(51) Int. Cl.

| | |
|---|---|
| ***A62C 3/00*** | (2006.01) |
| ***A62C 3/06*** | (2006.01) |
| ***A62C 35/00*** | (2006.01) |
| ***A62C 37/10*** | (2006.01) |
| ***A62C 99/00*** | (2010.01) |
| ***A62C 37/44*** | (2006.01) |
| ***A62C 3/08*** | (2006.01) |

(52) U.S. Cl.

CPC ..... *A62C 99/0018* (2013.01); *A62C 37/44* (2013.01); *A62C 3/08* (2013.01)

(58) Field of Classification Search

CPC ..... A62C 3/07; A62C 37/04; A62C 99/0009; A62C 99/0018

USPC ..... 169/9, 11, 16, 46, 56, 60, 61, 62, 71

See application file for complete search history.

(56) References Cited

U.S. PATENT DOCUMENTS

| | | | | |
|---|---|---|---|---|
| 3,804,175 | A * | 4/1974 | Miller | 169/46 |
| 3,965,988 | A * | 6/1976 | Wesson et al. | 169/9 |
| 4,036,024 | A | 7/1977 | Dreker et al. | |

(Continued)

FOREIGN PATENT DOCUMENTS

| | | |
|---|---|---|
| EP | 199087 | 10/1986 |
| EP | 1547651 | 6/2005 |

(Continued)

OTHER PUBLICATIONS

U.S. Appl. No. 12/470,817, filed May 22, 2009, entitled, "Fire Suppression System and Method".

(Continued)

*Primary Examiner* — Ryan Reis

(74) *Attorney, Agent, or Firm* — Carlson, Gaskey & Olds, P.C.

(57) ABSTRACT

A fire suppression system includes a high pressure inert gas source that is configured to provide a first inert gas output and a low pressure inert gas source that is configured to provide a second inert gas output. A distribution network is connected with the high and low pressure inert gas sources to distribute the first and second inert gas outputs. A controller is operatively connected with at least the distribution network to control how the respective first and second inert gas outputs are distributed.

32 Claims, 2 Drawing Sheets

(56) References Cited

U.S. PATENT DOCUMENTS

| | | | | |
|---|---|---|---|---|
| 4,643,260 | A * | 2/1987 | Miller | 169/46 |
| 4,688,183 | A | 8/1987 | Carll et al. | |
| 4,763,731 | A | 8/1988 | Adams et al. | |
| 5,188,186 | A | 2/1993 | Nash | |
| 5,501,284 | A | 3/1996 | Clodfelter et al. | |
| 5,622,438 | A | 4/1997 | Walsh et al. | |
| 5,848,650 | A | 12/1998 | Brady | |
| 5,899,275 | A | 5/1999 | Okamoto et al. | |
| 5,908,074 | A | 6/1999 | Potts | |
| 5,912,195 | A | 6/1999 | Walla et al. | |
| 6,003,608 | A | 12/1999 | Cunningham | |
| 6,053,256 | A | 4/2000 | Lu | |
| 6,082,464 | A | 7/2000 | Mitchell et al. | |
| 6,095,251 | A | 8/2000 | Mitchell et al. | |
| 6,181,426 | B1 | 1/2001 | Bender et al. | |
| 6,314,754 | B1 | 11/2001 | Kotliar | |
| 6,401,487 | B1 | 6/2002 | Kotliar | |
| 6,401,590 | B1 | 6/2002 | Coakley et al. | |
| 6,418,752 | B2 | 7/2002 | Kotliar | |
| 6,601,653 | B2 * | 8/2003 | Grabow et al. | 169/16 |
| 6,676,081 | B2 * | 1/2004 | Grabow et al. | 244/129.2 |
| 6,913,636 | B2 | 7/2005 | Defrancesco et al. | |
| 6,935,433 | B2 * | 8/2005 | Gupta | 169/46 |
| 6,997,970 | B2 | 2/2006 | Crome | |
| 7,040,576 | B2 | 5/2006 | Noiseux et al. | |
| 7,066,274 | B2 * | 6/2006 | Lazzarini | 169/54 |
| 7,073,994 | B2 | 7/2006 | Huer et al. | |
| 7,093,666 | B2 | 8/2006 | Trumper | |
| 7,207,392 | B2 | 4/2007 | Kotliar | |
| 7,223,351 | B2 | 5/2007 | Sharma et al. | |
| 7,232,097 | B2 | 6/2007 | Noiseux et al. | |
| 7,273,507 | B2 | 9/2007 | Schwalm | |
| RE40,065 | E | 2/2008 | Kotliar | |
| 7,331,401 | B2 | 2/2008 | Bobenhausen | |
| 7,333,129 | B2 | 2/2008 | Miller et al. | |
| 7,509,968 | B2 | 3/2009 | Surawski | |
| 7,688,199 | B2 | 3/2010 | Zhang et al. | |
| 7,726,408 | B2 * | 6/2010 | Reilly et al. | 169/16 |
| 2002/0040940 | A1 | 4/2002 | Wagner et al. | |
| 2002/0070035 | A1 | 6/2002 | Grabow et al. | |
| 2004/0055764 | A1 | 3/2004 | Bowyer et al. | |
| 2006/0278410 | A1 | 12/2006 | Reilly et al. | |
| 2008/0064316 | A1 | 3/2008 | Ng | |
| 2008/0290216 | A1 | 11/2008 | Lessie et al. | |

FOREIGN PATENT DOCUMENTS

| | | |
|---|---|---|
| GB | 2108839 | 5/1983 |
| WO | 2006103364 | 10/2006 |

OTHER PUBLICATIONS

European Search Report dated May 25, 2010.
Australian First Examination Report dated Jan. 25, 2011.
U.S. Appl. No. 12/816,416, filed Jun. 16, 2010, entitled Fire Supression System.

* cited by examiner

FIRE SUPPRESSION SYSTEM AND METHOD

This application claims priority to U.S. Provisional Application No. 61/210,842 filed Mar. 23, 2009.

BACKGROUND OF THE INVENTION

This disclosure relates to fire suppression systems and methods to replace halogenated fire suppression systems.

Fire suppression systems are often used in aircraft, buildings, or other structures having contained areas. Fire suppression systems typically utilize halogenated fire suppressants, such as halons. However, halogens are believed to play a role in ozone depletion of the atmosphere.

Most buildings and other structures have replaced halon-based fire suppression systems; however aviation applications are more challenging because space and weight limitations are of greater concern than non-aviation applications. Also the cost of design and recertification is a very significant impediment to rapid adoption of new technologies in aviation.

SUMMARY OF THE INVENTION

An exemplary fire suppression system includes a high pressure inert gas source that is configured to provide a first inert gas output and a low pressure inert gas source that is configured to provide a second and continuous inert gas output. A distribution network is connected with the high and low pressure inert gas sources to distribute the first and second inert gas outputs. A controller is operatively connected with at least the distribution network to control how the respective first and second inert gas outputs are distributed.

In another aspect, a fire suppression system includes a pressurized inert gas source that is configured to provide a first inert gas output and an inert gas generator that is configured to provide a second inert gas output.

A method for use with a fire suppression system includes initially releasing the first inert gas output in response to a fire threat signal to reduce an oxygen concentration of the fire threat below a predetermined threshold and then subsequently releasing the second inert gas output to facilitate suppressing the oxygen concentration below the predetermined threshold.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
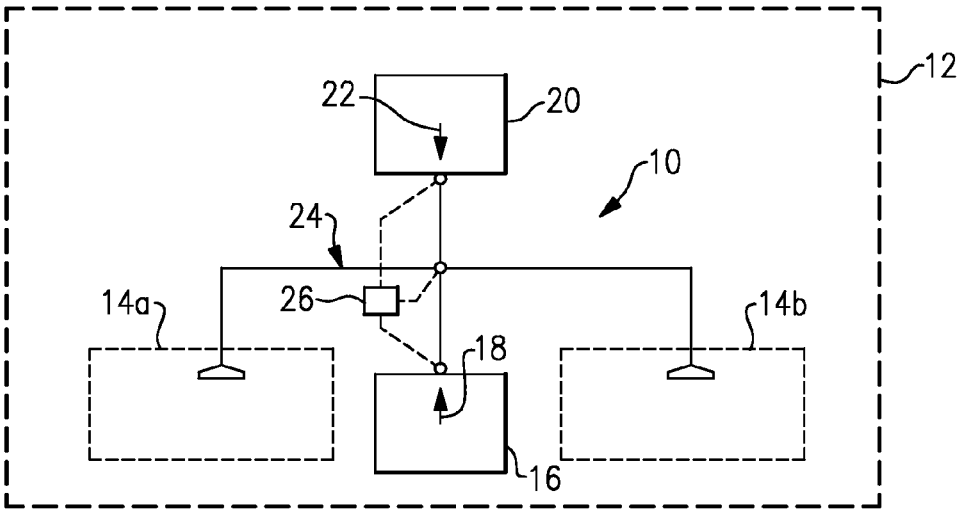
FIG. 1 illustrates an example fire suppression system.

FIG. 1 illustrates selected portions of an example fire suppression system 10 that may be used to control a fire threat. The fire suppression system 10 may be utilized within an aircraft 12 (shown schematically); however, it is to be understood that the exemplary fire suppression system 10 may alternatively be utilized in other types of structures.

In this example, the fire suppression system 10 is implemented within the aircraft 12 to control any fire threats that may occur in volume zones 14*a* and 14*b*. For instance, the volume zones 14*a* and 14*b* may be cargo bays, electronics bays, wheel well or other volume zones where fire suppression is desired. The fire suppression system 10 includes a high pressure inert gas source 16 for providing a first inert gas output 18, and a low pressure inert gas source 20 for providing a second inert gas output 22. For instance, the high pressure inert gas source 16 provides the first inert gas output 18 at a higher mass flow rate than the second inert gas output 22 from the low pressure inert gas source 20.

The high pressure inert gas source 16 and the low pressure inert gas source 20 are connected to a distribution network 24 to distribute the first and second inert gas outputs 18 and 22. In this case, the first and second inert gas outputs 18 and 22 may be distributed to the volume zone 14*a*, volume zone 14*b*, or both, depending upon where a fire threat is detected. As may be appreciated, the aircraft 12 may include additional volume zones that are also connected within the distribution network 24 such that the first and second inert gas outputs 18 and 22 may be distributed to any or all of the volume zones.

The fire suppression system 10 also includes a controller 26 that is operatively connected with at least the distribution network 24 to control how the respective first and second inert gas outputs 18 and 22 are distributed through the distribution network 24. The controller may include hardware, software, or both. For instance, the controller 26 may control whether the first inert gas output 18 and/or the second inert gas output 22 are distributed to the volume zones 14*a* or 14*b* and at what mass and mass flow rate the first inert gas output 18 and/or the second inert gas output 22 are distributed.

As an example, the controller 26 may initially cause the release the first inert gas output 18 to the volume zone 14*a* in response to a fire threat signal to reduce an oxygen concentration within the volume zone 14*a* below a predetermined threshold. Once the oxygen concentration is below the threshold, the controller 26 may cause the release of the second inert gas output 22 to the volume zone 14*a* to facilitate maintaining the oxygen concentration below the predetermined threshold. In one example, the predetermined threshold may be less than a 13% oxygen concentration level, such as 12% oxygen concentration, within the volume zone 14*a*. The threshold may also be represented as a range, such as 11.5-12%. A premise of setting the threshold below 12% is that ignition of aerosol substances, which may be found in passenger cargo in a cargo bay, is limited (or in some cases prevented) below 12% oxygen concentration. As an example, the threshold may be established based on cold discharge (i.e., no fire case) of the first and second inert gas outputs 18 and 22 in an empty cargo enclosure with the aircraft 12 grounded and at sea level air pressure.

Figure 2:
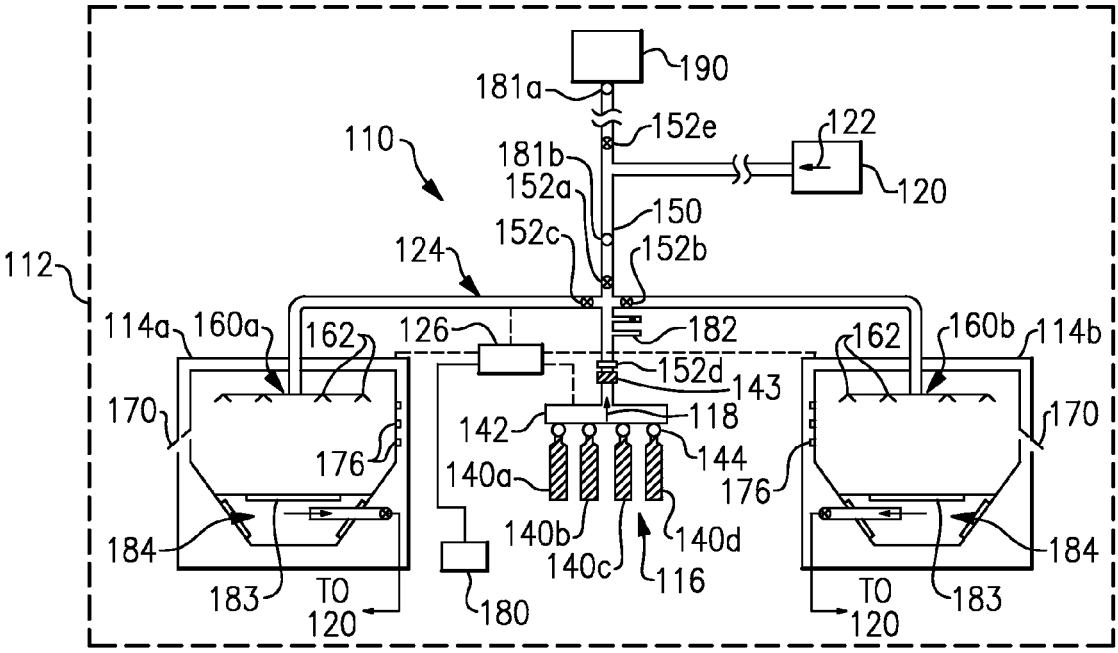
FIG. 2 illustrates another embodiment of a fire suppression system.

FIG. 2 illustrates another embodiment of a fire suppression system 110. In this disclosure, like reference numerals designate like elements where appropriate, and reference numerals with the addition of one-hundred designate modified elements. The modified elements may incorporate the same features and benefits of the corresponding original elements and vice-versa. The fire suppression system 110 is also implemented in an aircraft 112 but may alternatively be implemented in other types of structures.

The aircraft 112 includes a first cargo bay 114*a* and a second cargo bay 114*b*. The fire suppression system 110 may be used to control fire threats within the cargo bays 114*a* and 114*b*. In this regard, the fire suppression system 110 includes a pressurized inert gas source 116 that is configured to provide a first inert gas output 118, and an inert gas generator 120 configured to provide a second inert gas output 122. The pressurized inert gas source 116 and the inert gas generator 120 may also be regarded as respective high and low pressure inert gas sources. In this example, the pressurized inert gas source 116 provides the first inert gas output 118 at a higher mass flow rate than the second inert gas output 122 from the inert gas generator 120.

A distribution network 124 is connected with the pressurized inert gas source 116 and the inert gas generator 120 to distribute the first and second inert gas outputs 118 and 122 to the cargo bays 114*a* and 114*b*. A controller 126 is operatively connected with at least the distribution network 124 to control how the respective first and second inert gas outputs 118 and 122 are distributed. As described below, the controller 126 may be programmed or provided with feedback information to facilitate determining how to distribute the first and second inert gas outputs 118 and 122.

The pressurized inert gas source 116 may include a plurality of storage tanks 140*a-d*. The tanks may be made of lightweight materials to reduce the weight of the aircraft 112. Although four storage tanks 140*a-d* are shown, it is to be understood that additional storage tanks or fewer storage tanks may be used in other implementations. The number of storage tanks 140*a-d* may depend on the sizes of the first and second cargo bays 114*a* and 114*b* (or other volume zone), leakage rates of the volumes zones, ETOPS times, or other factors. Each of the storage tanks 140*a-d* holds pressurized inert gas, such as nitrogen, helium, argon or a mixture thereof. The inert gas may include trace amounts of other gases, such as carbon dioxide.

The pressurized inert gas source 116 also includes a manifold 142 connected between the storage tanks 140*a-d* and the distribution network 124. The manifold 142 receives pressurized inert gas from the storage tanks 140*a-d* and provides a volumetric flow through a flow regulator 143 as the first inert gas output 118 to the distribution network 124. The flow regulator 143 may have a fully open state, and intermediate states in between for changing the amount of flow. In this case, the flow regulator 143 is an exclusive outlet from the manifold 142 to the distribution network, which facilitates controlling the mass flow rate of the first inert gas output 118.

Each of the storage tanks 140*a-d* may include a valve 144 that is in communication with the controller 126 (as represented by the dashed line from the controller 126 to the pressurized inert gas source 116). The valves 144 may be used to release the flow of the pressurized gas from within the respective storage tanks 140*a-d* to the manifold 142. Additionally, the valves 144 may include or function as check valves to prevent backflow of pressurized gas into the storage tanks 140*a-d*. Alternatively, check valves may be provided separately. Optionally, the valves bodies 144 may also include pressure and temperature transducers to gauge the gas pressure (or optionally, temperature) within the respective storage tanks 140*a-d* and provide the pressure as a feedback to the controller 126 to control the fire suppression system 110. Pressure and optionally temperature feedback may be used to monitor a status (i.e., readiness "prognostics") of the storage tanks 140*a-d*, determine which storage tanks 140*a-d* to release, determine timing of release, rate of discharge or detect if release of one of the storage tanks 140*a-d* is inhibited.

The inert gas generator 120 may be a known on-board inert gas generating system (e.g., "OBIGGS") for providing a flow of inert gas, such as nitrogen enriched air, to a fuel tank 190 of the aircraft 112. Nitrogen enriched air includes a higher concentration of nitrogen than ambient air. Although OBIGGS is known, the inert gas generator 120 in this disclosure is modified via connection within the distribution network 124 to serve a dual functionality of providing inert gas to the fuel tank 190 and facilitating fire suppression.

In general, the inert gas generator 120 receives input air, such as compressed air from a compressor stage of a gas turbine engine of the aircraft 112 or air from one of the cargo bays 114*a* or 114*b* compressed by an ancillary compressor, and separates the nitrogen from the oxygen in the input air to provide an output that is enriched in nitrogen compared to the input air. The output nitrogen enriched air may be used as the second inert gas output 122. The inert gas generator 120 may also utilize input air from a second source, such as cheek air, secondary compressor air from a cargo bay, etc., which may be used to increase capacity on demand. As an example, the inert gas generator 120 may be similar to the systems described in U.S. Pat. No. 7,273,507 or U.S. Pat. No. 7,509,968 but are not specifically limited thereto.

In the illustrated example, the distribution network 124 includes piping 150 that fluidly connects the cargo bays 114*a* and 114*b* with the pressurized inert gas source 116 and the inert gas generator 120. The distribution network 124 may be modified from the illustrated example for connection with other volume zones.

The distribution network 124 includes a plurality of flow valves 152*a-e* and each valve 152*a-e* is in communication with the controller 126 (as represented by the dashed line from the controller 126 to the distribution network 124). The flow valves 152*a-e* may be known types of flow/diverter valves and may be selected based upon desired flow capability to the cargo bays 114*a* and 114*b*. In one example, one or more of the flow valves 152*a-e* are a valve disclosed in U.S. Ser. No. 10/253,297.

The controller 126 may selectively command the valves 152*a-e* to open or close to control distribution of the first and second inert gas outputs 118 and 122. Additionally, at least the flow valve 152*d* may be a valve that is biased toward an open position (e.g., a fail-open valve) to allow flow of the first inert gas output 118 in the event that the flow valve 152*d* is unable to actuate. The distribution network 124, the flow regulator 143, and the valves 144 may be designed to achieve a desired maximum discharge time for discharging all of the inert gas of the storage tanks 140*a-d*. In some examples, the discharge time may be approximately two minutes. Given this description, one of ordinary skill in the art will recognize other discharge times to meet their particular needs.

As an example, the flow valves 152*a-e* may each have an open and closed state for respectively allowing or blocking flow, depending on whether a fire threat is detected. In the absence of a fire threat, the valve 152*a* may be normally closed and valves 152*b-e* may be normally open. Check valve 181*a* prevents combustible vapor from the fuel tank 190 from entering the fire suppression system 110. Check valve 181*b* prevents high pressure from the fire suppression system 110 from entering the fuel tank 190 inerting piping. Relief valve 182 protects the inert gas distribution network 124 and valves 152*a-c* from overpressure in the event of a system failure. Valves 152*b* and 152*c* may be either normally open but may close in response to a fire threat, or normally closed then opened in response to a fire threat.

The distribution network 124 also includes an inert gas outlet 160*a* at the first cargo bay 114*a* and an inert gas outlet 160*b* at the second cargo bay 114*b*. In this case, each of the inert gas outlets 160*a* and 160*b* may include a plurality of orifices 162 for distributing the first inert gas output 118 and/or second inert gas output 122 from the distribution network 124.

Each of the first and second cargo bays 114*a* and 114*b* may also include an overboard valve 170 that limits the differential pressure between the interior of the cargo bay and the exterior (cheek/bilge). Each cargo bay 114*a* and 114*b* may also include a floor that separates the bay from a bilge volume below 184. On some aircraft the floors are not sealed allowing communications of the cargo bay atmosphere with the bilge atmosphere. These vented type floors may be equipped with seal members 183 (shown schematically), such as seals, shutters, inflatable seals or the like, that cooperate with the controller 126 to seal off the bilge volume 184 from the bay in response to a fire threat, to limit cargo bay volume and leakage, thus minimizing the amount of inert gas required from both inert gas sources 118 and 122.

Each of the cargo bays 114*a* and 114*b* may also include at least one oxygen sensor 176 for detecting an oxygen concentration level within the respective cargo bay 114*a* or 114*b*. However, in some examples, the fire suppression system may not include any oxygen sensors. The oxygen sensors 176 may be in communication with the controller 126 and send a signal that represents the oxygen concentration to the controller 126 as feedback. The inert gas generator 120 may also include one or more oxygen sensors (not shown) for providing the controller 126 with a feedback signal representing an oxygen concentration of the nitrogen enriched air. The cargo bays 114*a* and 114*b* may also include temperature sensors (not shown) for providing temperature feedback signals to the controller 126.

The controller 126 of the fire suppression system 110 may be in communication with other onboard controllers or warning systems 180 such as a main controller or multiple distributed controllers of the aircraft 112, and a controller (not shown) of the inert gas generator 120. For instance, the other controllers or warning systems 180 may be in communication with other systems of the aircraft 112, including a fire threat detection system for detecting a fire threat within the cargo bays 114*a* and 114*b* and issuing a fire threat signal in response to a detected fire threat or for the purpose of testing, evaluating, or certifying the fire suppression system 110.

The controller 126 may communicate with the controller of the inert gas generator 120 to control which input air source the inert gas generator 120 draws input air from and/or adjust the flow rate and oxygen concentration of the second inert gas output 122. For instance, the controller 126 may command the inert gas generator 120 to draw air from one of the cargo bays 114*a* or 114*b* where there is no fire threat or control where the inert gas generator 120 draws the input air from based on the flight cycle of the aircraft 112. Additionally, the controller 126 may adjust the oxygen concentration and/or flow rate of the second inert gas output 122 in response to a detected oxygen concentration in a volume zone where a fire threat occurs or in response to the flight cycle of the aircraft 112.

The following example supposes a fire threat within the first cargo bay 114*a*. The other on board controller or warning system 180 may detect the fire threat in the cargo bay 114*a* in a known manner, such as by smoke detection, video, temperature, flame detection, detection of combustion gas, or any other known or appropriate method of fire threat determination. Determination of the fire threat may be related to a predetermined threshold or rate increase of smoke, temperature, flame detection, combustion gas detection, or other characteristic.

In response to the fire threat, the controller 126, other on board controller or warning system 180 or both may shut down an air management/ventilation system prior to using the fire suppression system 110. The controller 126 may determine the timing for shutting off the air management/ventilation system, depending on received feedback information. In the absence of a fire threat, the air management/ventilation system may ventilate the cargo bays 114*a* and 114*b*. However, in a fire threat situation, reducing ventilation facilitates containing the fire threat.

The controller 126, which is programmed with the volume of the cargo bay 114*a* and other information, intelligently releases the first inert gas output 118. The controller 126 initially causes the release of the first inert gas output 118 from a required number of pressurized inert gas source 116 based on the known volume of the cargo bay 114*a* to reduce an oxygen concentration of the fire threat in the cargo bay 114*a* below a predetermined threshold. As an example, the predetermined threshold may be 12%. In this regard, the controller 126 may control how the first inert gas output 118 is distributed to the cargo bay 114*a*. For instance, an objective of using the controller 126 is to control distribution of the first and second inert gas outputs 118 and 122 to effectively control the fire threat while limiting overpressure of the cargo bay 114*a* and gas turbulence in the cargo bay 114*a*. The displacement of the atmosphere of the cargo bay 114*a* may also provide the benefit of cooling the cargo bay 114*a* and further contribute to fire threat suppression and aircraft structure protection.

The controller 126 is pre-programmed with the volumes of the cargo bay 114*a*, 114*b* etc, in addition to other information (such as the volume that one storage tank can protect), to enable the controller 126 to determine how to distribute the first inert gas output 118. As an example, cargo bay 114*a* may require four storage tanks of first inert gas output 118, whereas cargo bay 114*b* may require only three. The controller 126 will open the required number of valves 144 to discharge the correct quantity of gas, and to the correct location. Furthermore, the controller 126 may limit the mass flow rate based on the smaller volume of the cargo bay 114*b* by sequentially opening valves 144 to avoid over pressurization of the cargo bay 114*b*.

The controller 126 may also release multiple storage tanks 140*a-d* to ensure adequate mass flow of the first inert gas output 118 to the cargo bay 114*a*. For instance, feedback to the controller 126 may indicate that a previously selected inert gas source 116 is not discharging at the expected rate. In this case, the controller 126 may release another of the storage tanks 140*a-d* to provide a desired mass flow rate, such as to reduce the oxygen concentration below the predetermined threshold.

The controller 126 may also cause the flow valve 152*d* to release pulses of the first inert gas output 118. For instance, feedback to the controller may indicate that additional inert gas is needed to maintain the desired oxygen concentration. In this case, the controller 126 may provide pulses to flow valve 152*d*. The pulses are intended to maintain the oxygen concentration at the maximum concentration level acceptable without consuming excessive amounts of stored inert gas. This mode of operation may be used during a descent in a flight cycle.

Additionally, the controller 126 may be programmed to respond to malfunctions within the fire suppression system 110. For instance, if one of the valves 152*a-e* or valves 144 malfunctions, the controller 126 may respond by opening or closing other valves 152*a-e* or 144 to change how the first or second inert gas outputs 118 or 122 are distributed.

In some examples, the storage tank pressure provided as feedback to the controller 126 from the pressure transducers of the valves 144 permits the controller 126 to determine when a storage tank 140*a-d* is nearing an empty state. In this regard, as the pressure in any one of the storage tanks 140*a-d* depletes, the controller 126 may release another of the storage tanks 140*a-d* to facilitate controlling the mass flow rate of the first inert gas output 118 to the cargo bay 114*a*. The controller 126 may also utilize the pressure and temperature feedback in combination with known information about the flight cycle of the aircraft 112 to determine a future time for maintenance on the storage tanks 140*a-d*, such as to replace the tanks. For instance, the controller 126 may detect a slow leak of gas from one of the storage tanks 140*a-d* and, by calculating a leak rate, establish a future time for replacement that does is convenient in the utilization cycle of the aircraft 112 and that occurs before the pressure depletes to a level that is deemed to be too low.

Once a predetermined amount of gas from the first inert gas output 118 reduces the oxygen concentration below the 12% threshold, the controller 126 subsequently releases the second inert gas output 122 from the inert gas generator 120. The controller 126 may reduce or completely cease distribution of the first inert gas output 118 in conjunction with releasing the second inert gas output 122. In this case, the second inert gas output 122 normally flows to the fuel tank 190. However, the controller 126 diverts the flow within the distribution network 124 to the cargo bay 114*a* in response to the fire threat. For example, the controller 126 closes flow valves 152*b*, and 152*e*, and opens flow valve 152*a* to distribute the second inert gas output 122 to the cargo bay 114*a*.

The second inert gas output 122 is lower pressure than the pressurized the first inert gas output 118 and is fed at a lower mass flow rate than the first inert gas output 118. The lower mass flow rate is intended to maintain the oxygen concentration below the 12% threshold. That is, the first inert gas output 118 rapidly reduces the oxygen concentration and the second inert gas output 122 maintains the oxygen concentration below 12%. In this way, fire suppression system 110 uses the renewable inert gas of inert gas generator 120 to conserve the finite amount of high pressure inert gas of the pressurized inert gas source 116.

In some examples, if the capacity of the inert gas generator 120 exceeds the amount of the second inert gas output 122 used to maintain the oxygen concentration below the threshold, the controller 126 may use the additional capacity to replenish at least a portion of the inert gas of the storage tanks 140*a-d* using an ancillary high pressure compressor or the like. For instance, the additional capacity inert gas may be diverted from the inert gas generator 120, pressurized, and routed to the storage tanks 140*a-d*.

If, at some point in a flight profile, the oxygen concentration in the OBIGGS output rises above the predetermined threshold while supplying the second inert gas output 122, the controller 126 may communicate with the OBIGGS controller on the second inert gas output 122 to adjust the output to ensure that the NEA supplied is not diluting the required inert atmosphere and then release additional first inert gas output 118 to again maintain the oxygen concentration below the threshold. In some examples, releasing additional first inert gas output 118 may be triggered when the oxygen concentration begins to approach the predetermined threshold, or when a rate of increase of the oxygen concentration exceeds a rate threshold. In some cases, the controller 126 may release pulses of the first inert gas output 118 to assist the second inert gas output 122 in keeping the oxygen concentration below the threshold. The pulses, or even a continuous flow, of the first inert gas output 118 may be provided at the lower mass flow rate of the second inert gas output 122, or at some intermediate mass flow rate. In this regard, if one of the storage tanks 140*a-d* is near empty, the remaining inert gas in the storage tank, which is at a relatively low pressure, may be used. Alternatively, an additional source of inert gas may be provided to assist the second inert gas output 122 in keeping the oxygen concentration below the threshold.

Figure 3:
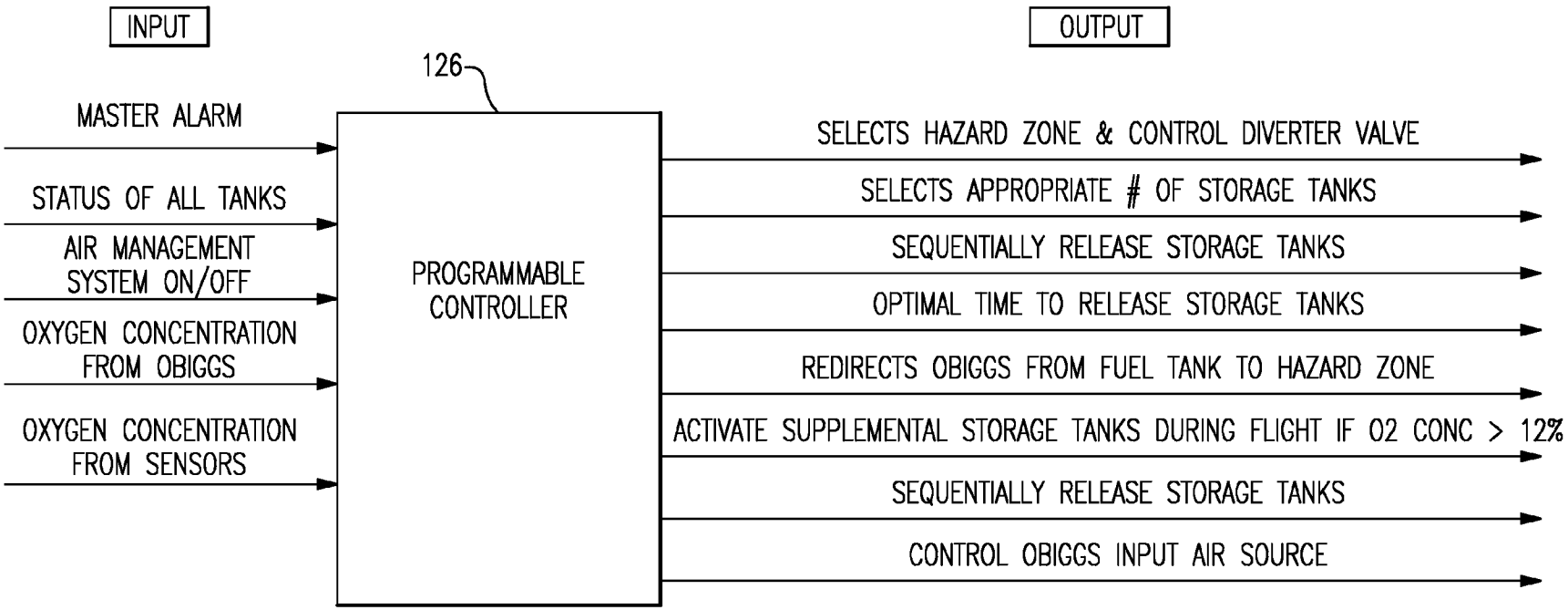
FIG. 3 schematically illustrates a programmable controller for use with a fire suppression system.

FIG. 3 illustrates a schematic diagram of the controller 126 and exemplary inputs and outputs that the controller 126 may use to operate the fire suppression system 110. For instance, the controller 126 may receive as inputs a master alarm signal from the other on board controller or warning system 180, the status of the storage tanks 140*a-d* (e.g., gas pressures), signals representing the status of the air management/ventilation system, signals representing the oxygen concentration from the oxygen sensor 176, and signals representing the oxygen concentration of the second inert gas output 122 from the inert gas generator 120. The outputs may be responses to the received inputs. For instance, in response to a fire threat in one of the cargo bays 114*a* or 114*b*, the controller 126 may designate the respective cargo bay 114*a* or 114*b* as a hazard zone and divert flow of the first inert gas output 118 to the designated hazard zone. Additionally, the controller 126 may designate the number of storage tanks 140*a-d* to be released to address the fire threat. The controller 126 may also determine a timing to release the storage tanks 140*a-d*. For instance, the controller 126 may receive feedback signals representing oxygen concentration, temperature, or other inputs that may be used to determine the effectiveness of fire suppression and subsequently the timing for releasing the storage tanks 140*a-d*.

The controller 126 may also use the inputs to determine a sequential release of the storage tanks 140*a-d* to suppress a fire threat and control mass flow rate of the first inert gas output 118 to avoid over pressurization. However, if over pressurization occurs relative to a predetermined pressure threshold, the overboard valves 170 may release pressure. Controlling the mass flow rates of the first inert gas output 118 to avoid or limit over pressurization may also enable use of smaller size overboard valves 170.

The fire suppression system 110 may also be tested and certified to determine whether the fire suppression system 110 meets desired criterion. For example, the fire suppression system 110 may be tested under predetermined, no fire threat conditions, such as when the aircraft 112 is grounded and at a desired atmospheric pressure (e.g., sea level), flying at altitude, or in a descent phase of the flight cycle. As an example, the fire threat signal may be manually activated to trigger the fire suppression system 110 under predetermined conditions.

In one example, the fire suppression system 110 is activated with empty cargo bays 114*a* and 114*b* such that the first inert gas output 118 releases into one of the cargo bays 114*a* or 114*b*. The fire suppression system 110 may reach and sustain an oxygen concentration or 12% or lower vol./vol. at sea level in the selected cargo bay 114*a* or 114*b* in less than two minutes. This test may be conducted for each volume zone that is intended to be protected using the fire suppression system 110

In another example, the fire suppression system 110 is activated with the aircraft 112 at altitude and with empty cargo bays 114*a* and 114*b* such that the first inert gas output 118 releases into one of the cargo bays 114*a* or 114*b*. The fire suppression system 110 may reach and sustain an oxygen concentration or 12% or lower vol./vol. in the selected cargo bay 114*a* or 114*b*. The second inert gas output 122 is released as needed to sustain a 12% oxygen concentration vol./vol. or lower during worst case flight altitude and ventilation conditions. This test may be conducted sequentially with a descent test or separately and may be conducted for each volume zone that is intended to be protected using the fire suppression system 110

In another example, the fire suppression system 110 is activated with the aircraft 112 in a cruise portion of the flight cycle and with empty cargo bays 114*a* and 114*b* such that the first inert gas output 118 releases into one of the cargo bays 114*a* or 114*b*. The fire suppression system 110 may reach and sustain an oxygen concentration or 12% or lower vol./vol. in the selected cargo bay 114*a* or 114*b*. The second inert gas output 122 is released as needed to sustain a 12% oxygen concentration vol./vol. or lower during worst case flight altitude and ventilation conditions. The aircraft is then placed in the worst case decent phase of flight. If necessary supplemental first inert gas output 118 maybe required to sustain the required 12% or below oxygen concentration. This test may be conducted sequentially with the altitude test or separately and may be conducted for each volume zone that is intended to be protected using the fire suppression system 110.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can be determined by studying the following claims.

What is claimed is:

1. A fire suppression system, comprising:

a high pressure inert gas source configured to provide a first inert gas output, the high pressure inert gas source including a plurality of storage tanks connected to a manifold;

a low pressure inert gas source, relative to the high pressure inert gas source, configured to provide a second inert gas output;

a distribution network connected with the high and low pressure inert gas sources to distribute the first and second inert gas outputs, wherein the manifold includes a single, exclusive outlet connected with the distribution network; and a controller operatively connected with at least the distribution network to control how the respective first and second inert gas outputs are distributed in response to a fire threat signal, wherein each of the plurality of storage tanks includes a valve in communication with the controller to control pressurized inert gas flow from the respective storage tank into the manifold.

2. The fire suppression system as recited in claim 1, wherein the controller is configured to initially release the first inert gas output in response to a fire threat to reduce an oxygen concentration of the fire threat below a predetermined threshold of 12% and subsequently release the second inert gas outlet once the oxygen concentration is below 12%.

3. The fire suppression system as recited in claim 1, wherein the low pressure inert gas source is an inert gas generator configured to convert input air to nitrogen enriched air as the second inert gas output.

4. The fire suppression system as recited in claim 3, wherein the controller is configured to select, from a plurality of input air sources, which input air source the inert gas generator receives the input air from.

5. The fire suppression system as recited in claim 1, wherein the distribution network includes a plurality of flow valves in communication with the controller.

6. The fire suppression system as recited in claim 1, further including at least one oxygen sensor in communication with the controller.

7. The fire suppression system as recited in claim 1, wherein the distribution network includes inert gas outlets located at different compartments.

8. A fire suppression system, comprising:

a pressurized inert gas source configured to provide a first inert gas output, wherein the pressurized inert gas source includes a plurality of storage tanks and a manifold connected to the plurality of storage tanks;

an inert gas generator configured to provide a second inert gas output;

a distribution network connected with the pressurized inert gas source and the inert gas generator to distribute the first and second inert gas outputs, wherein the manifold includes a single, exclusive outlet connected with the distribution network; and a controller operatively connected with at least the distribution network to control how the respective first and second inert gas outputs are distributed in response to a fire threat signal, wherein each of the plurality of storage tanks includes a valve in communication with the controller to control pressurized inert gas flow from the respective storage tank into the manifold.

9. The fire suppression system as recited in claim 8, wherein the distribution network includes a plurality of flow valves and a flow regulator located at the pressurized inert gas source to control the respective first and second inert gas outputs.

10. The fire suppression system as recited in claim 8, wherein the distribution network includes a fail-open valve.

11. The fire suppression system as recited in claim 8, wherein the controller is configured to change how the first and second inert gas outputs are distributed in response to a malfunction of a valve in the distribution network.

12. The fire suppression system as recited in claim 8, wherein the controller is configured to initially release the first inert gas output in response to the fire threat to reduce an oxygen concentration of the fire threat below 12% and subsequently release the second inert gas outlet once the oxygen concentration is below 12%.

13. A method for use with a fire suppression system that includes a high pressure inert gas source configured to provide a first inert gas output, wherein the pressurized inert gas source includes a plurality of storage tanks, a low pressure inert gas source, relative to the high pressure inert gas source, configured to provide a second inert gas output, a distribution network connected with the high and low pressure inert gas sources to distribute the first and second inert gas outputs, and a controller operatively connected with at least the distribution network to control how the respective first and second inert gas outputs are distributed in response to a fire threat signal, the method comprising:

sequentially releasing pressurized gas from the plurality of storage tanks to provide the first inert gas output from the high pressure inert gas source in response to the fire threat signal to reduce an oxygen concentration within a given volume zone that receives the first inert gas output below a predetermined threshold; and subsequently releasing the second inert gas output from the low pressure inert gas source to facilitate maintaining the oxygen concentration below the predetermined threshold.

14. The method as recited in claim 13, wherein subsequently releasing the second inert gas output includes redirecting the second inert gas output from another destination in the distribution network to the fire threat.

15. The method as recited in claim 13, wherein sequentially releasing the plurality of storage tanks includes initially releasing fewer than all of the plurality of storage tanks of the high pressure inert gas source.

16. The method as recited in claim 13, further including adjusting an oxygen concentration of the second inert gas output released from the low pressure inert gas source in response to a detected oxygen concentration in the given volume zone.

17. The method as recited in claim 13, further including releasing the first inert gas output from the high pressure inert gas source to thereby cool a volume of a volume zone to which the first inert gas output is directed.

18. The method as recited in claim 13, further including sealing a cargo bay volume, to which the first inert gas output is directed, from a bilge volume prior to releasing the first inert gas output.

19. The method as recited in claim 13, further including controlling at least one of a flow rate of the second inert gas output and an oxygen concentration of the second inert gas output based on a flight cycle.

20. The method as recited in claim 13, further including determining a future time for maintenance on a storage tank of the high pressure inert gas source based on tank pressure feedback from the storage tank and a flight cycle of an aircraft on which the high pressure inert gas source is installed.

21. The method as recited in claim 13, wherein releasing the first inert gas output and subsequently releasing the second inert gas output is conducted under predetermined test conditions in response to triggering the fire threat signal to test the fire suppression system.

22. The method as recited in claim 13, further including establishing a flow of at least one of the first inert gas output and the second inert gas output in conjunction with providing an overboard valve of the volume zone such that a pressure within the volume zone is below an over pressure that unseals a cargo bay liner of the volume zone.

23. The method as recited in claim 13, wherein the controller is operable to change how the first and second inert gas outputs are distributed to the volume zone in response to a malfunction in the distribution network.

24. The fire suppression system as recited in claim 1, wherein the controller is configured to release pulses of the first inert gas output from the high pressure inert gas source.

25. The fire suppression system as recited in claim 1, wherein the controller is configured to selectively release fewer than all of the plurality of storage tanks.

26. The fire suppression system as recited in claim 1, wherein each of the plurality of storage tanks includes a pressure and temperature transducer in communication with the controller.

27. The fire suppression system as recited in claim 8, wherein the controller is configured to selectively release fewer than all of the plurality of the storage tanks.

28. The fire suppression system as recited in claim 8, wherein each of the plurality of storage tanks includes a pressure and temperature transducer in communication with the controller.

29. The fire suppression system as recited in claim 8, wherein the distribution network includes a fail-open valve that is biased toward an open position.

30. The method as recited in claim 13, further including sealing a cargo bay volume, to which the first inert gas output is directed, from a bilge volume prior to releasing the first inert gas output, wherein the bilge volume is below a vented floor in the cargo bay, the vented floor including seal members in communication with the controller.

31. A fire suppression system, comprising:

a high pressure inert gas source configured to provide a first inert gas output;

a low pressure inert gas source, relative to the high pressure inert gas source, configured to provide a second inert gas output, wherein the low pressure inert gas source is an inert gas generator;

a distribution network connected with the high and low pressure inert gas sources to distribute the first and second inert gas outputs; and a controller operatively connected with at least the distribution network to control how the respective first and second inert gas outputs are distributed in response to a fire threat signal, wherein the controller is configured to select, from a plurality of input air sources, which input air source the inert gas generator receives the input air from to provide the second inert gas output.

32. A fire suppression system, comprising:

a pressurized inert gas source configured to provide a first inert gas output;

an inert gas generator configured to provide a second inert gas output;

a distribution network connected with the pressurized inert gas source and the inert gas generator to distribute the first and second inert gas outputs; and a controller operatively connected with at least the distribution network to control how the respective first and second inert gas outputs are distributed in response to a fire threat signal, wherein the controller is configured to change how the first and second inert gas outputs are distributed in response to a malfunction of a valve in the distribution network.

* * * * *